US009715963B2

(12) United States Patent
Gruenberg et al.

(10) Patent No.: US 9,715,963 B2
(45) Date of Patent: Jul. 25, 2017

(54) PLUG DEVICE FOR CONTACT-FREE INDUCTIVE ENERGY TRANSFER AND OPERATING METHOD FOR SUCH A PLUG DEVICE

(71) Applicants: Olaf Gruenberg, Blomberg (DE); Andreas Steinmetz, Horn-Bad Meinberg (DE)

(72) Inventors: Olaf Gruenberg, Blomberg (DE); Andreas Steinmetz, Horn-Bad Meinberg (DE)

(73) Assignee: Weidmueller Interface GmbH & Co. KG (DE)

( * ) Notice: Subject to any disclaimer, the term of this patent is extended or adjusted under 35 U.S.C. 154(b) by 546 days.

(21) Appl. No.: 14/360,646

(22) PCT Filed: Dec. 12, 2012

(86) PCT No.: PCT/EP2012/075189
§ 371 (c)(1),
(2) Date: May 26, 2014

(87) PCT Pub. No.: WO2013/087676
PCT Pub. Date: Jun. 20, 2013

(65) Prior Publication Data

US 2014/0327322 A1 Nov. 6, 2014

(30) Foreign Application Priority Data

Dec. 12, 2011 (DE) ..... 10 2011 056 265

(51) Int. Cl.
*H01F 27/42* (2006.01)
*H01F 38/14* (2006.01)

(52) U.S. Cl.
CPC ..... *H01F 38/14* (2013.01)

(58) Field of Classification Search
CPC ..... H01F 38/14
See application file for complete search history.

(56) References Cited

U.S. PATENT DOCUMENTS 4,942,352 A * 7/1990 Sano ..... H01F 38/14 320/134
6,476,520 B1 * 11/2002 Bohm ..... H01F 38/14 307/104

FOREIGN PATENT DOCUMENTS

CN 1387746 A 12/2002
CN 101252040 A 8/2008
(Continued)

*Primary Examiner* — Daniel Cavallari
(74) *Attorney, Agent, or Firm* — Laubscher, Spendlove & Laubscher, P.C.

(57) ABSTRACT

A contact-free electrical connector arrangement is provided for transferring inductive energy from a primary connector component to a secondary connector component, comprising a pair of connector components each including a housing containing a chamber, a ferrite core arranged in the chamber, and a coil arranged in the chamber for cooperation with the core. An input cable supplies electrical energy to the coil contained in the housing of a primary one of said components, and an output cable removes inductively-transferred energy from the coil contained in the housing of a secondary one of said components. According to an operating method of the invention, a parameter is measured at the primary coil for interrupting the energy supply when the secondary component is not present.

5 Claims, 2 Drawing Sheets

(56) References Cited

FOREIGN PATENT DOCUMENTS

| | | |
|---|---|---|
| DE | 2752783 | 1/1979 |
| DE | 4236286 | 6/1994 |
| DE | 10220450 | 11/2003 |
| DE | 69825651 | 8/2004 |
| DE | 102009019994 | 12/2009 |
| EP | 1686597 | 8/2006 |

* cited by examiner

PLUG DEVICE FOR CONTACT-FREE INDUCTIVE ENERGY TRANSFER AND OPERATING METHOD FOR SUCH A PLUG DEVICE

REFERENCE TO RELATED APPLICATIONS

This application is a national stage under 35 U.S.C. 371 of PCT International Application No. PCT/EP2012/075189 filed Dec. 12, 2012, claiming priority of German application No. DE 10 2011 056 265.6 filed Dec. 12, 2011.

BACKGROUND OF THE INVENTION

Field of the Invention

The invention relates to a connector device for contact-free energy transfer from a primary connector component to a secondary connector component, which components each have at least one coil, the connector components being inductively connected with each other. The invention moreover relates to an operating method for reliably operating such a connector device.

Description of Related Art

Compared to electrical connectors in which an energy transfer occurs via contact elements to be connected or disconnected, contact-free connector arrangements have advantages with regard to wear resulting from a high number of connection cycles or strong vibrations. In addition, contact burn-off during plugging or unplugging under an electrical load is prevented. In addition, the risk of the formation of light arcs at the time of the disconnection of the connectors under a high current load does not exist with contact-free connector devices. Finally, in the case of contact-free transfer of energy, there is a galvanic insulation between the primary part and the secondary part, which can be required, for example, for use in the medical sector. In addition, the absence of mechanically complicated mutually engaging contacts makes it possible to design the connector device with the smoothest possible surfaces, which makes the contact-free connector devices ideally suited for application purposes with increased requirements in terms of cleanliness/hygiene, for example, in the food sector.

The German printed publication No. DE 2 75 27 83 describes a connector arrangement for the transfer of electrical measurement signals, in particular in the medical field, in which the plug is integrated in a ring-shaped receiver coil which is connected inductively via a transfer gap to a transmission coil, which is also ring-shaped, in the counter-plug in the plugged-in state. An alternating voltage, which induces a voltage in the receiver coil of the plug, is applied to the transmission coil of the counter-plug, said voltage being used after rectification in order to operate an evaluation electronic system for the measured signals, which is provided in the plug component. By means of the evaluation electronic system, the measured signals are modulated to a light source, so that the measurement signals can be transmitted in the form of light signals with galvanic insulation from to the counter-plug. The indicated inductive energy transfer in adaptation to the intended purpose is suitable only for transferring small power for supplying the measurement electronic system and the light source for signal transmission.

In particular, the high resistance to wear makes a contact-free inductive energy transfer advantageous even in the automation sector, for example, for transferring energy to an interchangeable tool of a robot. However, for this purpose, powers are required that cannot be transferred via a device, as described in the above-mentioned German reference.

Therefore, the aim of the present invention is to provide a connector device of the type mentioned in the introduction, through which even higher electric powers, particularly in the range from several tens of watts to several hundred watts, can be transferred in a contact-free manner efficiently and reliably.

SUMMARY OF THE INVENTION

Accordingly, a primary object of the invention is to provide a connector arrangement for transferring inductive energy from a primary connector component to a secondary connector component, comprising a pair of connector components each including a housing containing a chamber, a ferrite core arranged in the chamber, and a coil arranged in the chamber for cooperation with the core. An input cable supplies electrical energy to the coil contained in the housing of a primary one of said components, and an output cable removes inductively-transferred energy from the coil contained in the housing of a secondary one of said components.

Another object is to provide an operating method wherein a parameter is measured at the primary coil for interrupting the energy supply when the secondary component is not present According to a further object, a connector arrangement is provided for contact-free inductive energy transfer from a primary component to a secondary component, which each have at least one coil and are inductively connected to each other, wherein the at least one coil works together with at least one ferrite core in each case. The ferrite core increases the magnetic flux due to its permeability to such an extent that even in the case of small construction sizes of the connector device and small transfer surface areas, higher electrical powers can be transferred. Due to the high magnetic flux, energy transfer is then also possible already at a time when the primary part and the secondary part are not yet in a connected position where the distance between them is at a minimum, and instead there is a gap between them. The energy transfer is as a result robust and not very susceptible to errors, even in the case of vibrations or in the case of the presence of other mechanical influences that lead to an increase in the distance between primary part and secondary part. In addition, it is also possible, for example, to activate secondary-side current-supplied guide or safety mechanisms already in a phase where two parts are approaching each other.

In an advantageous embodiment of the connector device, in the primary part, at least one inverter with electronic components is arranged integrally with a coil and the ferrite core in a housing. Also advantageously, in the secondary part, at least one rectifier with electronic components is arranged integrally with the coil and the ferrite core in a housing. In this manner, a connector device is produced, which can be arranged in a similarly simple manner to that of a mechanical-contact connector device, for example, in a cable for energy transfer.

In an additional advantageous design of the connector device, the respective electronic components are in thermal contact with the respective ferrite core. It is preferable for the electronic components to be arranged in the primary part and secondary part on a circuit board in each case, which is thermally connected via a heat-transferring medium to the ferrite core. As a result of the thermal connection, the respective ferrite core is heated due the power loss converted in the electronic components. Within a broad range of operating parameters of ferrite cores, the power losses thereof decrease due to re-magnetization processes with increasing temperature. The temperature increase on the ferrite core achieved by the thermal connection leads subsequently to lower losses in the ferrite core, as a result of which the overall degree of efficiency (transfer efficiency) of the connector device increases.

In a further advantageous design of the plug device, the interior of the housing is sealed off with respect to a surrounding medium, in particular with respect to a surrounding fluid. In this manner, the plug device can be used in dusty, sandy or moist environments. In addition, it can also be used under water, for example.

An operating method according to the invention for a connector device for contact-free inductive energy transfer from a primary part to a secondary part is characterized in that the primary part carries out a measurement of operating factors of a primary coil used for inductive energy transfer and prevents energy transfer depending on the measured operating factors. In this manner, it is possible for the primary part to detect when either no secondary part at all or a non-fitting or defective secondary part for inductive connection is located opposite from the primary part. It is precisely in the case of a connector device with the potential of transferring higher electrical energy that a hazard originating from the primary part is thus prevented.

In a preferred embodiment of the operating method, the operating factors relate to a voltage at the primary coil and/or to a current through the primary coil, which result(s) when an alternating voltage signal with predetermined parameters is applied to the primary coil. It is preferable here for the predetermined parameters to relate to factors, in particular to a duty factor, of a pulse width modulation (PWM) method which is used for generating the alternating voltage signal.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
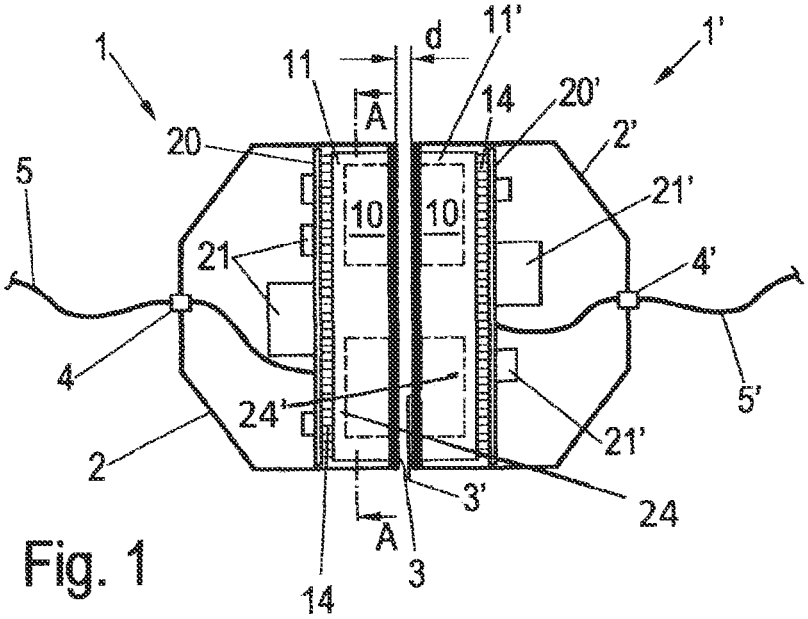
FIG. 1 is a somewhat diagrammatic illustration of the connector arrangement of the present invention.
Figure 2:
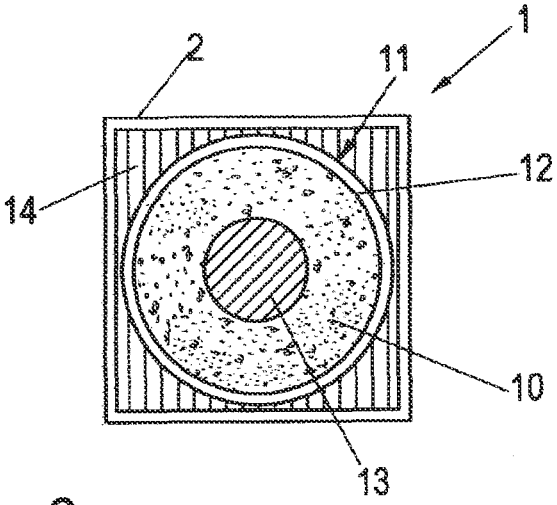
FIG. 2 is a sectional view taken along line A-A of FIG. 1.

Referring first more particularly to FIGS. 1 and 2, the connector arrangement of the present invention includes a pair of primary and secondary connector components 1 and 1' provided with generally half-shell shaped housings 2, 2' containing chambers that receive pot-shaped ferrite cores 11 and 11', respectively. The housing chambers are closed by front plates 3 and 3' that are parallel with the adjacent vertical faces of the cores when the components 1 and 1' are arranged in spaced relation by the spacing distance d shown in FIG. 1. The core front faces contain annular recesses 24 and 24' that define cylindrical central inner dome portions 13, 13', and annular outer marginal wall portions 11, 11'. Arranged in the annular recesses, respectively, are annular coils 10 and 10' that are connected with input and output cables 5 and 6 that extend through passages 4 and 4' contained in the walls of the housings 2 and 2' respectively. The coils 10 and 10' can each be wound with an individual conductor. However, in order to reduce the skin effect, it is preferable to use multi-core high frequency stranded wires.

In the represented embodiment example, the ferrite core 11, on the primary side and the secondary side, is a round pot core having an outer margin 12 and an inner dome 13 concentric with respect to said outer margin. Such a core is also referred to as a (cylindrically symmetrical) E core. Here the cross sections of the outer margin 12 and of the inner dome 13 are preferably approximately identical in size, in order to achieve a homogeneous magnetic flow density taking into consideration the different stray fields in the ferrite core 11. The use of ferrite cores having another geometry is also possible. For example, square or rectangular cores with round, square or rectangular ferrite cores can be used. Coils without coil body, for example, with conductors stuck to one another, can also be used.

Toward the respective front plates 3 and 3', the ferrite cores 11 and 11' are open, whereas, on the opposite side, the outer margins 12 and 12' and the inner dome portions 13 and 13' are connected to one another via a pot bottom. In each case, the coil 10 is inserted in the annular recesses 24, 24', between the outer margin 12, 12' and the inner dome portions 13, 13'. Any gap that may still be present between the outer margin and the inner margin of the coils 10, 10' and the ferrite cores 11, 11' can be filled with a heat-conducting medium.

During operation, for contact-free inductive energy transfer, the primary part 1 and the secondary part 1' are positioned with their front plates 3, 3' turned towards one another with a small distance between them. In FIG. 1, this distance, which forms a transfer gap, is drawn as transfer distance d. The transfer distance d is in the range from 0 to several millimeters or centimeters, depending on the size, in particular on the diameter of the coils 10 or ferrite cores 11. During operation, an alternating current is applied to the primary-side coil 10, hereafter also referred to as primary coil 10. Here, it is preferable for the primary coil 10 and a resonance capacitor to form a resonance circuit, the frequency of which is in the range from several kilohertz (kHz) to several hundred kHz, wherein a frequency in the range from several tens of kHz is particularly preferred. The alternating current that is applied to the primary coil 10 is produced by an inverter. In the inverter, for the purpose of generating the alternating voltage, a pulse width modulation method (PWM) is used here, for example. The inverter together with the monitoring and control devices is located on a circuit board 20 within the chamber contained in housing 2 of the primary part 1. In the figure, as an example, electronic components 21 are drawn on the circuit board 20. For the protection of the inverter against a resonance increase of the amplitude in the resonance circuit formed by the above-mentioned resonance capacitor and the primary coil 10, the resonance circuit is operated slightly above resonance, i.e., at a frequency above the resonance frequency.

In the case of energy transfer, the magnetic connection causes, between the primary coil 10 and the secondary-side coil 10', hereafter referred to as secondary coil 10', which is particularly efficient due to the ferrite coils 11 and 11' present. In the secondary coil 10', a voltage is induced, which, after rectification, voltage conversion (and optionally voltage stabilization), is available as output voltage at the connection cable 5' for the delivery of the transferred energy. The electronic components on the secondary side are also arranged on the circuit board 20', wherein here again, as an example, individual electronic components 21' are drawn. Advantageously, the secondary coil can have a central tap, so that a synchronous rectifier can be used.

The ferrite coils 11, 11' allow a high magnetic flux density, by means of which an efficient energy transfer is possible even in the case of small coil volumes. The transfer here is relatively tolerant with respect to a lateral shift of the primary part 1 and of the secondary part 1' with respect to one another. This is of great advantage, for example, in the automation field, since it is possible to dispense with high positioning accuracy for establishing a conventional mechanical-contact plug connection.

In the represented embodiment example of FIG. 1, no mutually engaging guide or position elements are provided, which would align the primary part 1 and the secondary part 1' laterally with respect to one another during the mutual insertion. As a result of the absence of such elements, the primary part 1 and the secondary part 1' can also be brought into the operating position or separated from one another by a lateral movement, that is a movement in the direction of the enlargement of the front plates 3, 3' into the operating position. This turns out to be particularly advantageous precisely in the automation field, since an additional axial movement of primary and secondary parts 1, 1' one onto the other is not needed for establishing or interrupting a plug connection. However, depending on the planned application purpose, in alternative designs, such guide or positioning elements can also be provided.

Both in the primary part 1 and also in the secondary part 1', heat conducting pads 14 are arranged between the respective ferrite core 11 and the circuit board 20. In particular on the primary side, but also on the secondary side, the electronic components 21 arranged on the circuit board 20 represent a large source of loss in the transfer path. The heat loss generated by these component elements 21 is transferred via the heat conducting pads 14 to the ferrite core 11. As a result, the ferrite core 11 heats up during operation to a higher operating temperature than would be the case without the thermal connection to the circuit board 20. As consequence, the efficiency of the energy transfer increases, as can be seen based on FIG. 3. Instead of the heat conducting pads 14, one can also use, for example, a casting compound in order to thermally connect the circuit board 20 and the ferrite core 11.

Figure 3:
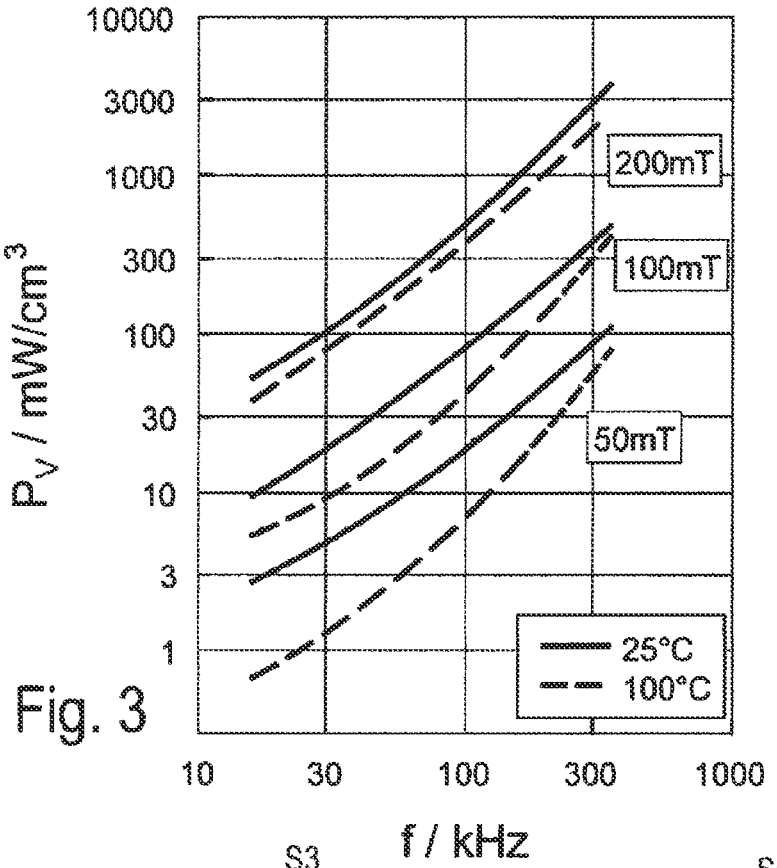
FIG. 3 is a graph illustrating specific power loss plotted against frequency in the case of a ferrite material under different operating conditions.

FIG. 3 shows dependencies of the specific power loss Pv for an example of a ferrite material of the ferrite core 11 as a function of the operating frequency f in a double logarithmic plot. The dependency is indicated in several curve pairs for different magnetizations varying between 50 millitesla (mT) and 200 mT. For each curve pair, the upper curve drawn with a solid line indicates the specific power loss at 25° C., that is approximately at room temperature, and the lower curve drawn with a broken line indicates the specific power loss at a temperature of 100° C. of the ferrite core 11. One can see that, over the entire frequency range represented, for each magnetization used, the losses at low temperature in the ferrite core 11 are greater than at higher temperature. The above described entry of the power loss of the electronic component as heat into the ferrite core 11 increases the temperature thereof and consequently lowers the power loss in the ferrite core 11 due to re-magnetization. As a result, the overall degree of efficiency of the transfer system is improved. This effect can be used both on the primary side and also on the secondary side. At the same time, the ferrite core 11, 11' present is used due to the thermal connection as a cooling body for the electronic components 21, 21', resulting, as an additional effect, in a saving of material and thus a cost saving.

During the operation of the connector arrangement, due to the high transferrable power, a hazard potential exists, when the primary part 1 is operated without having arranged opposite from it a fitting complementary secondary part 1'. In the most harmless case, the primary part 1 is "operated empty;" but this would mean an unnecessarily high idling energy consumption for the primary part, and this is undesirable with regard to undesired radiation of electromagnetic pollution. On the other hand, the operation of the primary part 1 can be less harmless if said part is positioned opposite from a conducting surface, for example, a metal surface. The currents induced in the surface can heat said surface. Consequently, the primary part should not be operated with a non-fitting or defective secondary part.

Figure 4:
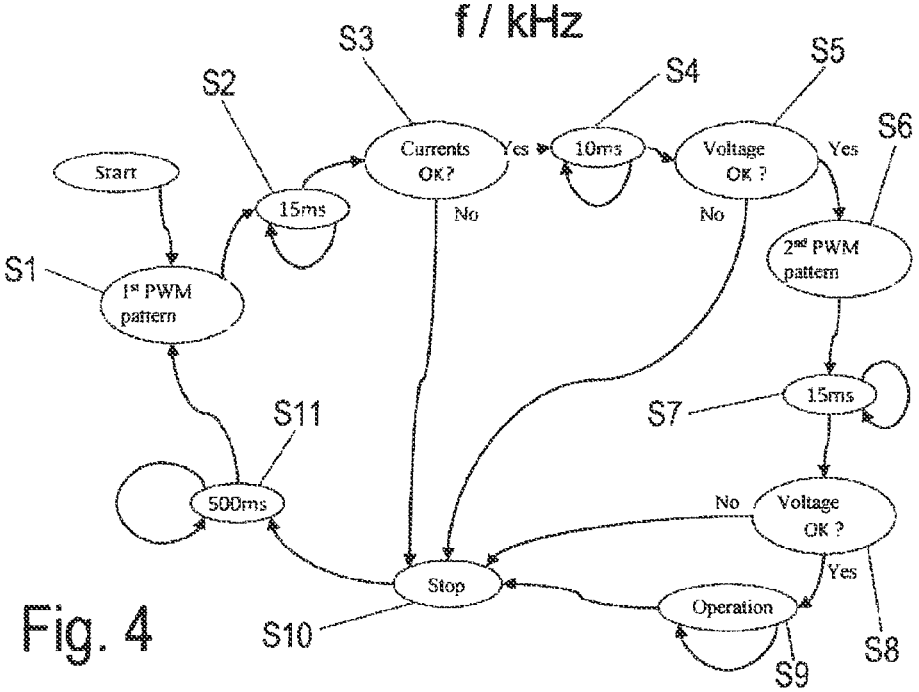
FIG. 4 is a flow diagram of an operating method for using the contact-free connector arrangement of the present invention.

In FIG. 4, an operating method for a plug connection for contact-free inductive energy transfer is described, which prevents both an increased idling energy consumption of the primary part 1, and also an uncontrolled energy transfer into another element than a suitable secondary part F. The represented operating method can be implemented, for example, with the plug connection described above in connection with FIGS. 1 and 2. Therefore, as an example, it is described in reference to this plug connection.

In a first step S1, an alternating voltage signal with predetermined first parameters is applied to the primary coil 10. In the represented example, first parameters predetermined for this purpose are set for a pulse width modulation (PWM) method, for example, a duty factor.

Subsequently, first in a step S2, a delay time of 15 milliseconds, for example, can be provided here, which is used to adjust the system to the settings in step S1. Step S2 is optional and can be omitted, if the system requires only a relatively short time in order to convert changed settings.

After step S2, in a step S3, the current through the primary coil 1 is measured as an operating factor of the primary coil 10. It is only when the secondary part 1' is present opposite from the primary part 1 that the measured current remains below a predetermined current limit value correlated with the first parameter. Additionally or alternatively, it is possible to provide that, in addition to the current through the primary coil 1 itself, the temporal rate of change of this current must be taken into consideration. On the secondary side, an intermediate circuit capacitor at the rectified voltage is usually provided, whose charging, after the setting of an alternating voltage signal with the predetermined first parameters, leads to a current change of the current through the primary coil 1 with a characteristic time response. It is therefore possible to determine in step S3 whether a secondary part 1' is located opposite from the primary part 1, both via the absolute value of the current and also via the rate of change thereof.

If no secondary part 1' is present, or even if a conducting surface is located opposite from the primary part 1, the measured current exceeds the limit value and/or its rate of change does not show the expected characteristic course. In this case, the method branches out to a step S10, in which voltage is no longer applied to the primary coil 10; in other words, no energy transfer takes place. In this state, the method remains in a step S11 for a relatively long delay time, which here is 0.5 second, for example. After the elapse of this delay time, the method is continued again with step S11, in which a first amplitude is again applied to the primary coil 10. In this cycle, the duration of which corresponds approximately to the delay time of step S11, the system thus attempts to establish an energy transfer (polling method). It is possible to provide that any secondary-side capacitor present is discharged via a discharge mechanism during the time of step 11, so that, at the time of a new start of the method, the startup occurs with step S1 under the same initial conditions. This is advantageous particularly for step S3 and the verification of the current values or current change values that occurs there. For discharging, on the secondary side, a current sink can be provided, which is switched off after the connection of primary part 1 and secondary part 1' has occurred (see step S9), in order to reduce the current consumption.

If it is observed in step S3, that the measured current is under the limit value and/or exhibits the expected time dependency, the method is continued after an additional short delay time in step S4 with a step S5, in which the level of the voltage at the primary coil 10 is determined as an additional operating factor. If it is observed in step S5 that the voltage does not satisfy certain predetermined prerequisites, the method again branches out to step S10. On the other hand, if the voltage is in the predetermined range, the method is continued with a step S6.

In step S6, an alternating voltage signal with predetermined second parameters is applied to the primary coil 10. In this regard, in the represented example, analogously to step S1, second parameters of the PWM method are set, again via the duty factor, for example. After a renewed, optional delay time in step S7, which is used for adjusting the system to the changed operating conditions (see step S2), the voltage applied to the coil is again measured in a subsequent step S8. If this voltage does not satisfy second predetermined voltage criteria, which are correlated with the second parameters, the system again branches out to step S10. Now, if it is observed in step S8 that the second criteria are also satisfied, the method is continued with a step S9, in which the primary coil 10 is operated for energy transfer.

During the operation of the primary part 1 in step S9, the current through the primary coil 1 and/or through the switching elements of the inverter is determined continuously. If the absolute value of the current exceeds a predetermined limit value, the operation is interrupted, and the method is branched out to step S10. In this manner, an excessively high load on the secondary side is recognized on the primary side. Moreover, based on the currents, the curve shape at the output of the inverter is verified. Excessively large deviations of the curve shape from a sine curve indicate an incorrect secondary side. A removal of an otherwise fitting secondary part 1' can also be detected in this manner. In such a case, the method also branches out to step S10.

The represented method has the advantage that an incorrect second side can be recognized on the primary side. No response from the secondary part 1' to the primary part 1 is required to guarantee a reliable operation of the primary part 1. In an operating environment, the system can be exposed to temperatures in a broad temperature range, for example, between −20° C. and 100° C., due to environmental conditions and/or also due to intrinsic power loss. The parameters and/or limit values used in the method, for example, in steps S3 and S8, can be predetermined as a function of the temperature, in order to ensure a correct process sequence at every possible operating temperature, with reliable detection of a correctly working secondary side.

In an alternative design of the plug connector, it is possible to use alternatively or additionally a safety mechanism based on a response from a secondary part to a primary part.

In a further alternative design of the plug connector, it is possible to provide for the continuous determination and verification of the size of the air gap during operation. The air gap can be determined on the basis of a detuning of the resonance circuit via the resonance frequency possibly in connection with the current flowing in the primary coil. It is possible to provide for preventing the energy transfer when a predetermined distance d is exceeded (see FIG. 1).

Moreover, it is possible to provide, on the secondary side, an energy buffering, for example, by means of a high-capacity capacitor, in order to maintain operation or emergency operation, on the secondary side, in the case of a temporary loss of voltage, for example, within during tool exchange.

In an advantageous design of the plug device, the latter is designed for operation in a fluid medium. For this purpose, on the one hand, the housing 2 is sealed in connection to the front plate 3 with respect to this fluid medium. On the other hand, a heat insulation can be provided, in addition, for example, in the form of a thin air gap between the ferrite core 11 and the front plate 3, in order to produce the above-described effect of efficiency improvement by heating the ferrite core 11 even within a fluid, surrounding, medium that has rather a cooling effect. In addition, the transfer via the transfer gap d can be optimized to changed magnetic susceptibilities of the liquid medium. The seal between the housing 2 and the front plate 3 advantageously also provides protection from dust and soiling.

While in accordance with the provisions of the Patent Statutes the preferred forms and embodiments of the invention have been illustrated and described, it will be apparent to those skilled in the art that changes may be made without deviating from the invention described above.

What is claimed is:

1. A method for operating a contact-free connector arrangement for transferring inductive energy from the primary coil arranged on a first ferrite core of a primary connector component to the coil arranged on a second ferrite core of a secondary connector component, comprising the steps of:

(a) applying electrical power to said primary coil;

(b) measuring a parameter of the power applied to the primary coil; and (c) stopping the supply of power to said primary coil if the measured parameter is below a predetermined value, whereby the supply of power to the primary coil is interrupted in the absence of a secondary connector component.

2. A method for operating a contact-free connector arrangement as defined in claim 1, wherein the measured parameter is the level of current in said primary coil.

3. A method for operating a contact-free connector arrangement as defined in claim 1, where the measured parameter is the temporal rate of change of current in said primary coil.

4. A method for operating a contact-free connector arrangement as defined in claim 1, wherein the measured parameter is the level of the voltage at the primary coil.

5. A method for operating a contact-free connector arrangement as defined in claim 1, wherein the measured parameter is a factor of pulse width modulation (PWM) at the primary coil.

* * * * *